US009415287B2

(12) United States Patent
Greiwe

(10) Patent No.: US 9,415,287 B2
(45) Date of Patent: Aug. 16, 2016

(54) BALANCE REHABILITATION AND TRAINING APPARATUS

(71) Applicant: Biodex Medical System, Inc., Shirley, NY (US)

(72) Inventor: Jeffrey Scott Greiwe, Fort Thomas, KY (US)

(73) Assignee: BIODEX MEDICAL SYSTEMS, INC., Shirley, NY (US)

( * ) Notice: Subject to any disclaimer, the term of this patent is extended or adjusted under 35 U.S.C. 154(b) by 128 days.

(21) Appl. No.: 14/082,220

(22) Filed: Nov. 18, 2013

(65) Prior Publication Data

US 2014/0141950 A1 May 22, 2014

Related U.S. Application Data

(60) Provisional application No. 61/729,131, filed on Nov. 21, 2012.

(51) Int. Cl.

| | |
|---|---|
| ***A63B 22/14*** | (2006.01) |
| ***A63B 22/16*** | (2006.01) |
| ***A63B 69/00*** | (2006.01) |
| ***A63B 71/06*** | (2006.01) |
| ***A61H 1/00*** | (2006.01) |
| ***A63B 26/00*** | (2006.01) |
| *A63B 22/18* | (2006.01) |

(52) U.S. Cl.

CPC ..... *A63B 69/0057* (2013.01); *A61H 1/005* (2013.01); *A63B 21/4035* (2015.10); *A63B 26/003* (2013.01); *A63B 71/06* (2013.01); *A61H 2201/5061* (2013.01); *A61H 2201/5084* (2013.01); *A63B 22/18* (2013.01); *A63B 2208/0204* (2013.01)

(58) Field of Classification Search

CPC ..... A63B 22/18; A63B 26/003; A63B 2208/0204; A63B 22/16; A63B 22/14; A63B 21/1492; A63B 22/0056; A63B 21/015

USPC ..... 482/139, 142, 146; 600/595; 601/125; 434/258–261

See application file for complete search history.

(56) References Cited

U.S. PATENT DOCUMENTS 4,093,214 A * 6/1978 Coker et al. ..... 482/98
4,258,913 A * 3/1981 Brentham ..... 482/45

(Continued)

OTHER PUBLICATIONS

Stedman's Pocket Medical Dictionary, 2010, Lippincott Williams and Wilkins.

(Continued)

*Primary Examiner* — Oren Ginsberg
*Assistant Examiner* — Andrew S Lo
(74) *Attorney, Agent, or Firm* — Ulmer & Berne LLP

(57) ABSTRACT

A balance rehabilitation and training apparatus and method of using the apparatus is disclosed. The apparatus includes a support member, an optional base member, a handle carriage structure, a free-floating handle container member and a free-floating handle member. The apparatus allows the user to perform balance enhancing exercises while holding the free-floating handle member within the area inscribed within the free-floating handle container member thus allowing the user to experience postural sway during the course of the exercise to reinforce the appropriate motor program. The apparatus provides rehabilitation and training in balance impaired patients and in individuals without balance impairment but who seek to enhance postural stability.

23 Claims, 12 Drawing Sheets

(56) References Cited

U.S. PATENT DOCUMENTS

| | | | | |
|---|---|---|---|---|
| 4,373,717 | A * | 2/1983 | Lambert, Jr. | 482/45 |
| 4,720,099 | A * | 1/1988 | Carlson | 482/133 |
| 5,112,045 | A * | 5/1992 | Mason et al. | 482/9 |
| 5,162,030 | A * | 11/1992 | Tanski | 482/91 |
| 5,209,240 | A * | 5/1993 | Jain et al. | 600/592 |
| 5,391,132 | A * | 2/1995 | Greenwald | 482/91 |
| 6,450,928 | B1 * | 9/2002 | Larkins, Jr. | 482/110 |
| 6,471,624 | B1 * | 10/2002 | Voris | 482/142 |
| 6,569,066 | B1 * | 5/2003 | Patterson et al. | 482/99 |
| 6,607,497 | B2 | 8/2003 | McLeod | |
| 6,666,798 | B2 * | 12/2003 | Borsheim | 482/54 |
| 7,226,396 | B2 * | 6/2007 | Buechel et al. | 482/66 |
| 7,465,253 | B2 * | 12/2008 | Perry et al. | 482/51 |
| 7,645,221 | B1 | 1/2010 | Curry | |
| 7,980,856 | B2 * | 7/2011 | Grabiner et al. | 434/258 |
| 8,057,362 | B2 * | 11/2011 | Nadim | 482/51 |
| 8,113,996 | B1 * | 2/2012 | Allen | 482/57 |
| 2002/0035017 | A1 * | 3/2002 | Pertegaz-Esteban | 482/92 |
| 2003/0134721 | A1 * | 7/2003 | Greenland | 482/93 |
| 2003/0134722 | A1 * | 7/2003 | Greenland | 482/100 |
| 2006/0019800 | A1 * | 1/2006 | Berger et al. | 482/46 |
| 2006/0166797 | A1 * | 7/2006 | Hamer | 482/121 |
| 2007/0219060 | A1 * | 9/2007 | Liang | 482/52 |
| 2008/0242521 | A1 * | 10/2008 | Einav | 482/110 |
| 2009/0048073 | A1 * | 2/2009 | Roimicher et al. | 482/52 |
| 2009/0111657 | A1 * | 4/2009 | Snow et al. | 482/4 |
| 2009/0111660 | A1 * | 4/2009 | Snow et al. | 482/38 |
| 2010/0160124 | A1 * | 6/2010 | Berenshteyn | 482/106 |
| 2010/0164201 | A1 * | 7/2010 | Hochberg et al. | 280/304.1 |
| 2011/0086742 | A1 * | 4/2011 | Burnfield | A61H 1/0214 482/7 |
| 2011/0312473 | A1 * | 12/2011 | Chu et al. | 482/54 |
| 2013/0190662 | A1 * | 7/2013 | Stevenot et al. | 601/33 |
| 2014/0081186 | A1 * | 3/2014 | Paris | 601/33 |

OTHER PUBLICATIONS

Behdad Tahayori, The inflow of sensory information for the control of standing is graded and bidirectional, Exp Brain Res, 2012, 111-118, 218, Springer-Verlag.

Behdad Tahayori, Activity-dependent plasticity of spinal circuits in the developing and mature spinal cord, Neural Plasticity, 2012, Hindawi Publishing.

A. Hufschmidt, Some methods and parameters of body sway quantification and their neurological applications, Arch Psychiatr Nervekn, 1980, 135-150, 228.

M. Duarte, On the fractal properties of natural human standing, Neurosci. Lett., 2000, 173-176, 238.

M.L. Latash, Neurophysiological basis of movement, 1997, Human Kinetics, Champaign, IL, USA.

E.R. Kandel, Principles of neural science, 2000, McGraw-Hill, New York, USA.

Behdad Tahayor, Rambling and trembling in response to body loading, Motor Control, 2012, 144-157, 16.

V.M. Zatsoprslu, Rambling and trembling in quiet standing, Motor Control, 2000, 185-200, 4.

* cited by examiner

BALANCE REHABILITATION AND TRAINING APPARATUS

CROSS-REFERENCE TO RELATED APPLICATIONS

This application claims the benefit of priority from U.S. Provisional Application Ser. No. 61/729,131, filed Nov. 21, 2012, which is incorporated by reference herein in its entirety.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISC APPENDIX

Not Applicable

BACKGROUND OF THE INVENTION

The invention relates to an apparatus designed to facilitate balance rehabilitation and training. Balance training is major component of rehabilitation programs for numerous disease states because it can improve functional balance, decrease fear of falling, and prevent falls. The vestibular, vision, and proprioception systems are responsible for maintaining upright posture. These systems receive input in response to perturbations in posture (postural sway) during standing and respond continuously with an appropriate motor program to maintain posture. Balance exercise exerts postural challenges to the patient which reinforces learning of the appropriate motor program. Through repeated and ongoing reinforcement of the appropriate motor program, the patient will experience enhanced balance which over time will lead to decreased falls and fear of falling.

Neuroplasticity of the motor program that controls posture requires consistent reinforcement through balance exercises. Consequently, patients are encouraged to perform balance exercises regularly. The common practice for performing balance exercises independent of a therapist is for the patient to start by holding onto a stable surface with both hands and then progressing to holding with one hand, then one finger, and then not holding onto anything. The rationale for encouraging patient not to hold onto anything, despite that fact that it increases fear of falling and fall risk, is to reinforce the appropriate motor program in response to unimpeded postural sway. Patients are encouraged to stand near a structure that can provide support if they lose their balance. Chairs are often used despite the fact that they are not inherently designed to support a standing individual and to prevent falling. It would be advantageous if the patient could hold onto free-floating handles during balance exercise and if these handles could provide stable support when the patient's postural sway becomes too large or they begin to fall. By comparison, conventional stable handles, while providing support, reduce postural sway and decrease the effectiveness of the exercise. The fear of falling for a person who is balanced impaired can be consuming and debilitating and lead to an increased risk of falling. Unless the patient can overcome this fear, balance training is not effective. Devices known in the sports medicine and physical therapy art provide balance training but fail to consider the importance of postural sway. Thus, there is a need for an adaptive balance training apparatus which allows for postural sway while also helping the patient cope with the fear of falling. The apparatus of the invention allows the balance impaired patient to cope with the fear so they can perform the exercises necessary to improve functional balance, decrease fear of falling, and prevent falls.

There have been many approaches to physical training. For example one device is the subject of U.S. Pat. No. 7,226,396 B2, Jun. 5, 2007. Buechel and Hoobler disclose a portable exercise device for rehabilitation and fitness training specifically for senior adults and individuals recovering from major joint surgery. As stated in the patent, the exercise devise comprises "a frame having a plurality of side members, a horizontal cross bar, a plurality of vertical members attached to a bracket where each vertical member contains a telescoping member of smaller size, a general U-shaped handle attached to the tubes and a plurality of wheels attached to the frame. The invention provides a stable support mechanism for the user but does not disclose that the apparatus is intended for balance exercises.

U.S. Pat. No. 6,607,497 B2 Aug. 19, 2003—McLeod and Rubin disclose a method to treat postural instability. The method includes standing on a non-rigid platform which vibrates for a predetermined period of time. The platform has a handrail attached for the patient to use for support.

U.S. Pat. No. 5,162,030 Nov. 10, 1992—Tanski discloses a vertical balance bar exercise apparatus for use when performing one leg squat exercise. The vertical bar is stationary [held in place] by an apex shaped structure that is mounted to a wall. The vertical bar has a movable grip that permits axial movement along the vertical bar. The invention provides a movable grip or handle but only allows movement along the vertical bar and is not intended for balance exercise and does not allow for postural sway but only axial movement during the squatting exercise.

U.S. Pat. No. 7,645,221 B1 Jan. 12, 2010—Curry discloses an exercise apparatus which is comprised of a base on which the exerciser stands that is connected to a platform by springs thus creating an unstable base. The apparatus is also comprised of a T-shaped safety handle that connects to the base.

SUMMARY OF THE INVENTION

Balance is defined as the system that depends on vestibular function, vision, and proprioception to maintain posture, navigate in one's surroundings, coordinate motion of body parts, modulate fine motor control, and initiate the vestibulooculomotor reflexes (Stedman's Pocket Medical Dictionary, Copyright 2010). Functional balance is the ability to maintain balance during activities of daily living.

Free-floating for purposes of this invention is a defined as capable of free movement, unattached, or lacking specific attachment.

The apparatus and method of the present invention are intended for individuals that can benefit from improving or maintaining their functional balance. These individuals include individuals without balance impairments as well as individuals that have balance impairments due to various conditions such as aging, trauma, accidents, and numerous disease states. These conditions include but are not limited to: aging, physical inactivity, visual impairments, vertigo, inner ear damage, concussion, war related injuries, neuromuscular diseases, joint replacement, prosthesis, medications, movement disorders, peripheral neuropathy, and cerebral palsy. Functional improvements in balance leads to decrease risk of falling and lower morbidity and mortality from injuries sustained from falls and the effects thereof such as sprains, fractures, contusions, lacerations and the like.

The present invention provides a balance rehabilitation and training apparatus and describes the method of using the apparatus to train or rehabilitate the user in need of balance enhancement.

It is an object of the invention to provide a portable balance training apparatus.

It is an object of the invention to provide a portable balance training apparatus comprising a free-floating user handle member, the user handle member confined within an area inscribed by the perimeter of at least one conic container member, which conic member may be cylindrical, annular, circular, oval, elliptical or the like and wherein such member inscribes an opening or orifice, to receive a handle member, and wherein such container member is mounted on at least one support member.

It is an object of the invention to provide a portable balance training apparatus comprising a free-floating user handle member, the handle member confined within an area inscribed by the inner perimeter of at least one conic container member, which conic member may be adjusted to change the size and shape of the opening or orifice to receive a handle member. The size and shape of the handle member is adaptable to fit adjustable within an area inscribed by the inner perimeter of at least one conic container member. This adaptability will accommodate for individuals with different levels of balance impairments or for different conditions or disease states.

It is an object of the invention to provide a portable balance training apparatus comprising a free-floating user handle member, the handle member confined within an area inscribed by the inner perimeter of at least one conic container member, which conic member may be cylindrical, circular, oval, elliptical or the like and wherein such user handle member is variable in circumference and length such that the handles are adaptable to various hand shapes and sizes.

It is an object of the invention to provide a balance training apparatus comprising a plurality of vertical free-floating user handle members, each handle member confined within an area inscribed by the perimeter of at least one conic container member mounted on a support member or on a plurality of support members.

It is an object of the invention to provide a balance training apparatus comprising a horizontal base or platform member with at least one vertical structural member supporting a plurality of vertical free-floating user handle members, each user handle member confined within at least one orifice with an area inscribed by the perimeter of at least one conic container member, which conic member may be cylindrical, annular, circular, oval, elliptical or the like and wherein the user handle member is variable in circumference and length such that the user handle is adaptable to various hand shapes and sizes and wherein the conic container member is supported by the vertical structural member.

It is an object of the invention to provide a balance apparatus comprising a free-floating user handle member contoured to the shape of a child's hand.

It is an object of the invention to provide a balance apparatus comprising a free-floating user handle member contoured to the shape of a child's hand less than 5 years old, less than 7 years old, less than 12 years old, less than 15 years old and less than 18 years old.

It is an object of the invention to provide a balance apparatus comprising a free-floating user handle member contoured to the shape of an adult male's hand or an adult female's hand.

It is an object of the invention to provide a balance apparatus comprising a free-floating user handle member contoured to the shape of an adult male who is less than 30 years old, less than 50 years, old less than 65 years old, less than 75 years old, less than 85 years old or alternately an, adult female who is less than 30 years old, less than 50 years old, less than 65 years old, less than 75 years old or less than 85 years old.

It is an object of the invention to provide a balance apparatus comprising a horizontal base or platform member with a vertical structural member supporting a vertical free-floating handle wherein a floating user handle member is confined within an area inscribed by the perimeter of a conic cylinder member and wherein the conic member is supported by the vertical structural member.

It is an object of the invention to provide a balance apparatus comprising a horizontal base or platform member with at least one vertical structural member supporting at least one free-floating user handle which free-floating user handle floats within an orifice with an area inscribed by the perimeter of at least one conic member wherein the conic member is supported by the vertical structural member.

It is an object of the invention to provide a balance apparatus comprising a horizontal base or platform member with a vertical structural member supporting at least one stable handle member and supporting at least one vertical free-floating handle, which handle comprises a free-floating user handle that floats within an area inscribed by the perimeter of at least one conic cylinder member.

It is an object of the invention to provide a balance apparatus comprising a horizontal base or platform member with at least one vertical structural member supporting a plurality of vertical free-floating user handles and a plurality of conic cylinder members each floating member confined by a conic member, wherein each free-floating user handle floats within an area inscribed by the perimeter of at least one conic cylinder member and wherein the conic member is supported by the vertical structural member.

It is an object of the invention to provide an apparatus for use during balance rehabilitation and training in balance impaired patients and individuals without balance impairment to enhance patient learning of postural stability with an appropriate motor program using a free-floating support structure comprising at least one free-floating handle member in association with at least one handle container member, which training combines postural challenges of different magnitudes and temporal orientations independent of the stationary support structure.

It is an object of the invention to provide a balance exercise and rehabilitation apparatus comprising free-floating handles that include as an example an accelerometer, gyroscope, and or ohmic sensing device to provide feedback to the user or therapist via visual, auditory, and or tactile stimuli. The feedback system can be used alone or in conjunction with other biofeedback systems.

It is an object of the invention to enhance the appropriate motor program responsible for the control of upright standing in the balance impaired patient.

It is an object of the invention to enhance the appropriate motor program responsible for the control of upright standing in the balance impaired patient independent of a stationary support structure.

It is an object of the invention to enhance the appropriate motor program responsible for the control of upright standing in the balance impaired patient using a balance exercise apparatus which comprises a free-floating handle support structure.

It is an object of the invention to enhance patient learning of postural stability with an appropriate motor program using a free-floating support structure by combining postural challenges of different magnitudes and temporal orientations independent of a stationary support structure.

It is an object of the invention to provide a method of treating the balanced impaired patient by training postural stability with the use of a balance exercise apparatus which comprises a free-floating support structure.

It is an object of the invention to provide a method of treating the balanced impaired patient by reinforcing the appropriate motor program responsible for the control of upright standing using a balance exercise apparatus which comprises a free-floating support structure.

It is an object of the invention to enhance patient learning of postural stability with an appropriate motor program to decrease the risk of falling and morbidity and mortality associated with falling.

It is an object of the invention to enhance patient learning of postural stability with an appropriate motor program to decrease the fear of falling.

It is an object of the invention to improve the functional balance of a patient who is a child, an adolescent, an adult.

It is an object of the invention to improve the functional balance of a patient who is less than 6 years of age, less than 12 years of age, less than 16 years of age, less than 18 years of age, less than 25 years of age, less than 30 years of age, less than 50 years of age, less than 60 years of age, less than 80 years of age.

It is an object of the invention to enhance the appropriate motor program responsible for the control of upright standing patterns in individuals without balance impairments.

It is an object of the invention to enhance the appropriate motor program responsible for the control of upright standing in individuals without balance impairments independent of a stationary support structure.

It is an object of the invention to enhance the appropriate motor program responsible for the control of upright standing in individuals without balance impairments using a balance exercise apparatus which comprises a free-floating support structure of the invention.

It is an object of the invention to enhance learning of postural stability using a free-floating support structure of the invention by combining postural challenges of different magnitudes and temporal orientations independent of a stationary support structure in individuals without balance impairments.

It is an object of the invention to enhance learning of postural stability using a free-floating support structure of the invention by combining postural challenges of different magnitudes and temporal orientations independent of a stationary support structure in individuals with balance impairments.

It is an object of the invention to provide a method of improving or maintaining balance by training postural control with the use of a free-floating support structure of the invention in individuals without balance impairments.

It is an object of the invention to provide a method of improving or maintaining functional balance by reinforcing a motor program using a free-floating support structure in individuals without balance impairments.

It is an object of the invention to provide a method of improving or maintaining functional balance by reinforcing a motor program using a free-floating support structure in individuals with balance impairments.

It is an object of the invention to provide a method of improving or maintaining balance by reinforcing a motor program using a free-floating support structure in individuals without balance impairments.

It is an object of the invention to improve functional balance which leads to decreased morbidity and mortality associated with falls.

It is an object of the invention to allow for postural sway during balance rehabilitation and training.

It is an object of the invention to decreases anxiety associated with fear of falling in a balance impaired patient to facilitate balance rehabilitation and training.

It is an object of the invention to prevent falls and associated injuries during balance rehabilitation and training.

It is an object of the invention to increase compliance to balance rehabilitation and training program.

It is an object of the invention to allow balance rehabilitation and training with or without a therapist present.

It is an object of the invention to permit balance rehabilitation and training at a rehabilitation center, exercise facility or at home.

It is an object of the invention to provide a space saving portable rehabilitation and training apparatus that is compact and portable and which can be stably attached to other equipment or household devices.

It is an object of the invention to provide a space saving rehabilitation and training apparatus that is compact and can be permanently attached to a wall or other stable object.

These and other embodiments of the invention will become apparent in light of the description of the invention provided.

The general purpose of the present invention is to provide a balance rehabilitation and training apparatus which provides many advantages for the user and therapist while performing balance exercises as well as other exercises. The apparatus will provide the security and safety of holding onto an apparatus to overcome the fear of falling and help prevent falling while also allowing postural sway to occur. Since postural sway during balance exercise is necessary for optimal gains in balance, this apparatus will increase the effectiveness of training and lead to greater functional balance.

Maintaining an upright postural involves complex interactions between several subsystems. Individuals rely on their visual, vestibular, and somatosensory systems to provide information regarding the body location within the context of the environment (Latash, Human Kinetics, 1997). The brain and spinal cord interpret the sensory information and respond with an appropriate motor program. Motor control is the ability to regulate or direct the mechanisms essential to movement. Motor control/motor program originates in the CNS which organizes a variety of muscles, tendons, joints and sensory information from the body and the environment. This system is important for responding to both expected and unexpected perturbations in posture. Tahayori et al. (Tahayori, et al, 2012, Exp Brain Res.) have shown that the reflex gains in this system are highly adaptive through inter-neuronal adjustments, which are controlled by difference areas of the CNS. The term activity-dependent plasticity describes the changes experienced in the CNS in response to movement activities. These activity-dependent changes occur throughout the CNS. Specifically, movement and activity cause extensive reorganization between the brain and spinal neurons and between sensory neurons and motor neurons of the spinal cord (Tahayori and Koceja, 2012, Neural Plasticity). Improvements in balance through postural challenges during balance rehabilitation may be explained by this activity-dependent plasticity of spinal circuits. This plasticity is not limited to early development in life but exist throughout the life span. This is supported for improvements in balance with training as experienced by older individuals as well as children and adults that have experienced trauma or disease.

In addition to the sensory information, the visual and vestibular systems provide important input about the movement of the head and body relative to the surrounding environment. The complex interaction between these systems has been study for the last century. Many postural control theories have been developed to explain the complicated interactions that are necessary to maintain posture. At the most basic level, the reflex theory suggests the spinal cord is responsible for postural control as suggested by the observation that lab animals can stand and or walk on a treadmill after cutting the spinal cord to eliminate input from the brain. As our scientific tools have advanced to evaluate these complex interactions, so have the theories of postural control. These new theories recognize the complex interactions between the feedback and feedforward systems and how they maintain postural control (Kandel et al, 2000, McGraw-Hill). Work continues in the area of postural control to fully elucidate the control mechanisms for this extremely important biological function.

Another common theory of postural control is the equilibrium point hypothesis. The basic concept of the equilibrium point hypothesis is that the CNS maintains standing by transiently shifting the center of pressure from one equilibrium point to another. It has been suggested that postural sway is controlled by at least two subsystems (Tahayor, et al., 2012, Motor Control). Rambling-trembling analysis is an accepted methodology to determine the specific contributions of these subsystems related to the equilibrium point hypothesis. Specifically, the center of pressure trajectory can be decomposed into postural control deviations resulting from supraspinal (i.e., rambling) and spinal processes (i.e., trembling). This is an important tool for evaluating changes in the contributions of these subsystems as a result of a treatment regimen.

Individuals have decreased functional balance due to various conditions such as aging, trauma, accidents and numerous disease states or conditions due to the effects on the various systems that control balance. The individuals described herein are contemplated as users of this apparatus and include without limitation.

Older individuals have decreased functional balance due to the altered sensory proprioception, reflexes and motor control, vestibular system, and visual stimuli.

Healthy individuals without underlying medical disease state may have decreased functional balance due to an inactive lifestyle since the systems that control balance are highly adaptive and require continuous utilization.

Individuals with visual impairments have decreased functional balance due to the altered or lack of visual stimuli.

Individuals with vertigo and inner ear damage have decreased functional balance due to the altered vestibular system.

Individuals that have undergone joint replacement or have prosthesis have decreased functional balance due to the altered sensory proprioception, reflexes, and motor control.

Individuals that have neuromuscular disease have decreased functional balance due to the altered sensory proprioception, reflexes, and motor control.

Individuals that have experienced a concussion or multiple concussions have decreased functional balance due to the altered CNS function.

Individuals that have experienced a brain injury or war related injury have decreased functional balance due to the altered CNS function.

Individuals that take certain medications have decreased functional balance due to the alterations in the balance systems or by dizziness caused by the medications Individuals that have movement disorders have decreased functional balance due to altered neuromuscular control.

Individuals that have peripheral neuropathy have decreased functional balance due to altered sensory proprioception, reflexes motor control, and neuromuscular control.

Individuals that have cerebral palsy have decreased functional balance due to altered CNS and neuromuscular control.

Individuals that have normal balance and would like to maintain or improve their functional balance to maintain quality of life.

Individuals have normal balance and would like to improve their functional balance to improve sports performance or prevent injuries.

Balance training and or rehabilitation training periods with the balance apparatus of the present invention will vary according to each subject's physical condition and balance capability at the start of the training. It is contemplated that training may run from at least about 1 second, at least about 2 seconds, to at least about 5 seconds, to at least about 10 seconds, to at least about 20 seconds, to at least about 30 seconds, to at least about 40 seconds, to at least about 50 seconds, to at least about 60 seconds, at least about 2 minutes, at least about 3 minutes, at least about 4 minutes, to at least about 5 minutes, to at least about 10 minutes, to at least about 20 minutes, to at least about 30 minutes, to at least about 45 minutes, to at least about 60 minutes in duration. Sessions are envisioned over a period of at least about 1 day, at least about 2 days, at least about 3 days, at least about 4 days, at least about 5 days, at least about 6 days, at least about 7 days a week and run from for at least about 1 week, at least about 2 weeks, at least about 3 weeks, at least about 4 weeks to at least about 6 months, at least about 12 months, at least about 18 months, at least about 2 years, at least about 3 years, at least about 4 years, at least about 5 years.

DETAILED DESCRIPTION OF THE INVENTION

Figure 1:
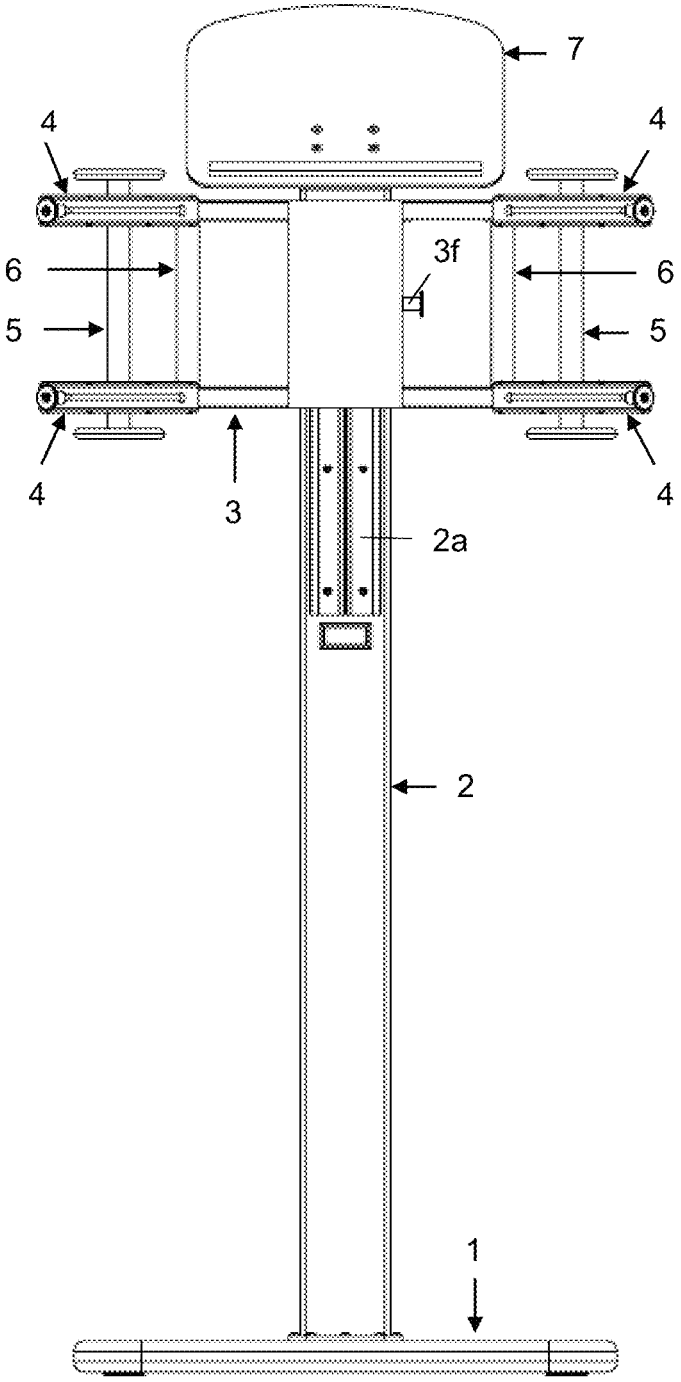
FIG. 1 includes a front facing view from the perspective of the user of an embodiment of the balance rehabilitation and training apparatus.

The balance rehabilitation and training apparatus is intended for individuals that can benefit from improving their balance. This includes healthy individuals to improve or maintain balance as well as individuals that have decreased functional balance due to various conditions such as aging, trauma, accidents, and numerous disease states and the like.

All publications, patent applications, patents, and other references mentioned herein, if not otherwise indicated, are explicitly incorporated by reference herein in their entirety for all purposes as if fully set forth.

Unless otherwise defined, all technical and scientific terms used herein have the same meaning as commonly understood by one of ordinary skill in the art to which this invention belongs. In case of conflict, the present specification, including definitions, will control.

When an amount, distance, length, spacing or other value or parameter is given as a range, or a list of upper and lower values, this is to be understood as specifically disclosing all ranges formed from any pair of any upper and lower range limits, regardless of whether ranges are separately disclosed. Where a range of numerical values is recited herein, unless otherwise stated, the range is intended to include the end-points thereof, and all integers and fractions within the range. It is not intended that the scope of the present invention be limited to the specific values recited when defining a range.

When the term "about" is used in describing a value or an end-point of a range, the invention should be understood to include the specific value or end-point referred to.

As used herein, the terms "comprises," "comprising," "includes," "including," "has," "having" or any other variation thereof, are intended to cover a non-exclusive inclusion. For example, a process, method, article, or apparatus that comprises a list of elements is not necessarily limited to only those elements but can include other elements not expressly listed or inherent to such process, method, article, or apparatus. Further, unless expressly stated to the contrary, "or" refers to an inclusive or and not to an exclusive or. For example, a condition A or B is satisfied by any one of the following: A is true (or present) and B is false (or not present), A is false (or not present) and B is true (or present), and both A and B are true (or present).

The use of "a" or "an" to describe the various elements and components herein is merely for convenience and to give a general sense of the invention. This description should be read to include one or at least one and the singular also includes the plural unless it is obvious that it is meant otherwise.

The use of inscribe herein should be read to describe an inner boundary of an orifice. Herein, inscribe could be or is used interchangeably with circumscribe.

The term postural challenges used herein describe static stances, dynamic movements, and or exercises that provide challenges to balance (as defined previously). Balance exercises and postural challenges could be used interchangeable. Examples of postural challenges include but are not limited to the following: static standing on stable and unstable surfaces, weight shifts (toe-heel, right-left), head turns (up-down, right-left), stationary marching on stable and unstable surfaces, tandem stance, one leg standing, and leg swings. These can be performed with eyes open and eyes closed and or with and without visual distortion.

The base or platform described herein may be comprised of shapes that include: an oval, a circular form, a square base, a rectangular, triangular form or the like.

The carriage structure described herein may be comprised of a structure about shoulder-width for a child or an adult and partially surround the form of the user.

The carriage structure described herein may be comprised of a U-shaped, half-circular form, a half-square form, a triangular form or the like.

Reference will now be made to the embodiments or examples of the free-floating support structure (free-floating/movable support structure) of the invention as illustrated in the drawings. It will be understood however that discussion of one or more specific examples are provided to promote an understanding of the invention and should not limit the scope of the invention.

Referring to FIGS. 1-5, a portable balance apparatus for rehabilitation and training is described herein comprising a base member (1), a vertical support member (2), and a U-shaped carriage structure (3) to which free-floating handle container (4) free-floating handle (5), and optional stable handle (6) are attached.

In one embodiment of the invention, the base member (1) comprises a solid platform to provide ground support for the user and structural support for the apparatus. Wheeled members as well as adjustable supports may be attached on the bottom of the platform to accommodate transport and for use in leveling the apparatus with floor surfaces. A variety of shapes and sizes are envisioned for the base member (1). Continuing with FIGS. 1-5, a vertical support member (2) is a tubular structure attached to the base member (1) by a plurality of fastening means. The vertical support member (2) is adjustably attached to a carriage structure (3) which is generally U-shaped and which supports free-floating handle container members (4), vertical free-floating handles (5), and vertical stable handles (6).

Figure 5:
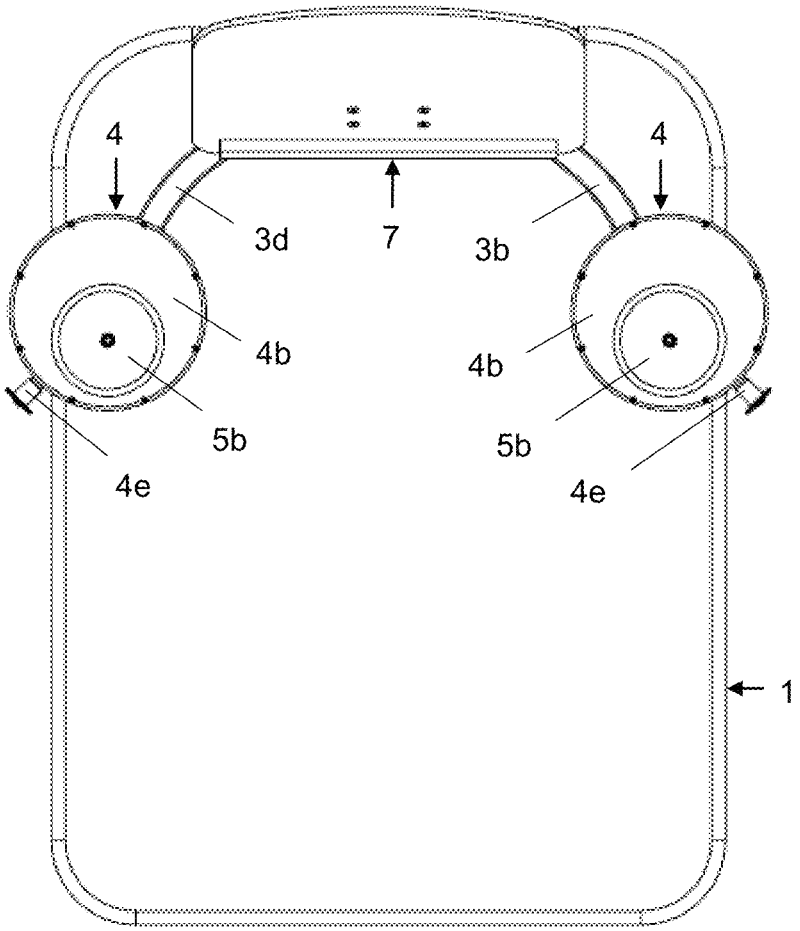
FIG. 5 includes a top view of the balance rehabilitation and training apparatus of FIG. 1.
Figure 6:
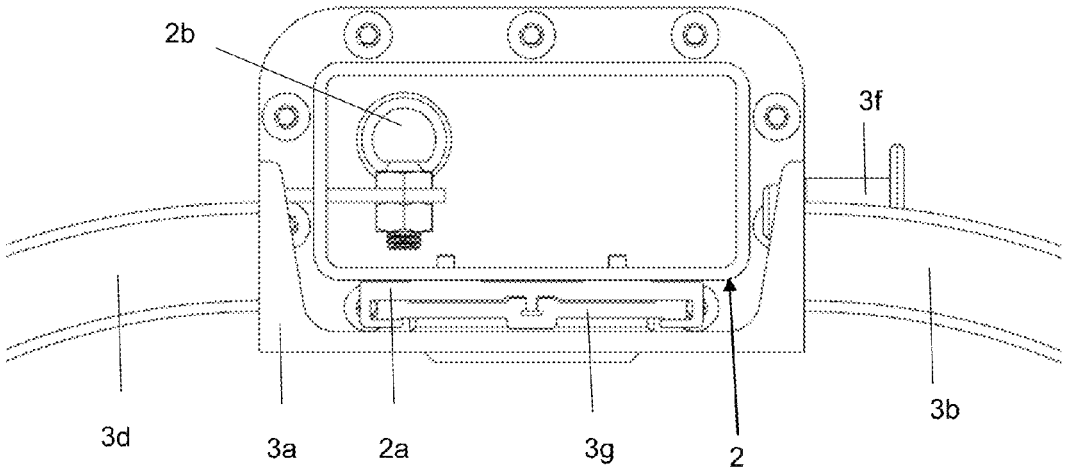
FIG. 6 includes an expanded top view of the balance rehabilitation and training apparatus of FIG. 5 with lectern removed. The view is a close up of the connection between the vertical support member and carriage structure.

Referring to FIG. 6, the carriage structure (3) comprises a three-sided, rectangular, U-shaped center carriage member (3*a*). The U-shape center carriage member (3*a*) creates a channel to accommodate a vertical support member (2). Specifically, the channel created by the center carriage member (3*a*) is slightly wider than the vertical support member (2) to allow the vertical support member (2) to fit within the three sides of the center carriage member (3*a*) (See FIG. 6). Now referring to FIG. 7, the carriage structure (3) in this embodiment includes two sets of two arched tubes to create arched horizontal tubular carriage arms (3*b*, 3*c* & 3*d*, 3*e*). Each arm is approximately equal in length with a first arm oriented directly above and parallel but spaced apart from the second arm (3*b*, 3*c*). Each arm extends from the center carriage member (3*a*) in the horizontal plane at a radius ranging from about 4-7 inches. The arched horizontal tubular carriage arms (3*b*, 3*c*) are attached to the right side of the center carriage member (3*a*) with the second set (3*d*, 3*e*) attached to the left side. The arched horizontal tubular carriage arms (3*b*, 3*c* & 3*d*, 3*e*) create a generally open U-shape carriage structure (3) that extends outwardly from the vertical support member (2) toward the user allowing the user to center their body within the support frame (See FIG. 5).

Figure 7:
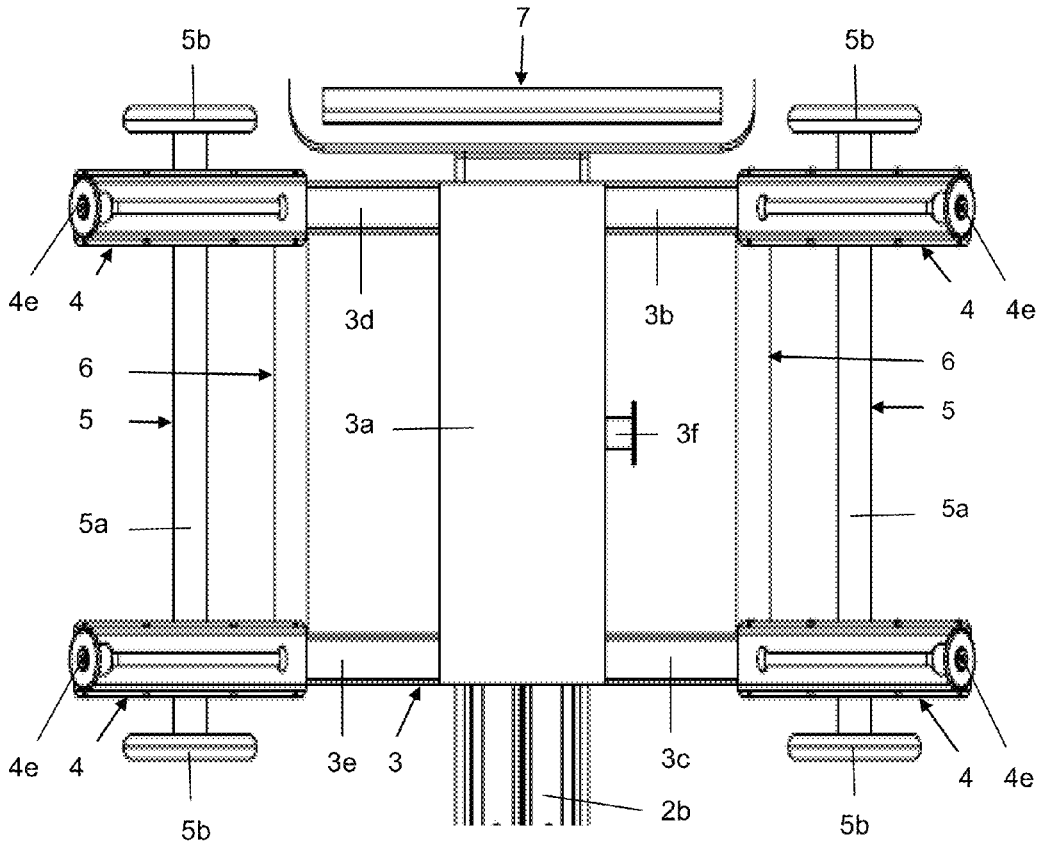
FIG. 7 includes an expanded view of a carriage structure of the balance rehabilitation and training apparatus of FIG. 1.

Continuing with FIG. 7, this embodiment comprises two sets of two free-floating handle container members (4). Each free-floating handle container member is formed as a conical structure in annular ring form with an outer diameter and an inner diameter in which the outer diameter exceed the inner diameter. The four free-floating handle container members (4) are attached to the carriage structure (3). The two free-floating handle container members are attached horizontally along the longitudinal plane to the arched horizontal tubular carriage arms (3*b*, 3*c*, 3*d*, 3*e*). Specifically, they are affixed to the end of the arched horizontal tubular carriage arm (3*b*, 3*c*, 3*d*, 3*e*) opposite the end at the center carriage member (3*a*) at about shoulder-width apart or about 150-170 degrees in the horizontal plane. The two free-floating handle container members (4) on right side of the carriage structure (3) are oriented directly above and parallel from each other but spaced apart. The two free-floating handle container members on the left side are similarly orientated.

The carriage structure (3) is adjustable so it can be moved to the correct height for each user. The carriage structure (3) is adjustably connected to the vertical support member (2) with a linear slide rail system comprised of a linear slide rail (2*a*) and two carriers (3*g*) (See FIG. 6). Referring now to FIG. 1 and FIG. 6, a linear slide rail (2*a*) is attached to the uppermost terminal end of the vertical support member (2) with a plurality of fasteners. The slide rail (2*a*) extends downwardly and proximate to the vertical support member (2). Two linear carriers (3*g*) are attached to the center carriage member (3*a*) with a plurality of fasteners. The carriage structure (3) and the vertical support member (2) are connected when the linear carriers (3*g*) on the center carriage member (3*a*) are positioned within the linear slide rail (2*a*) on the vertical support member (2). This allows the carriage structure to slide up and down along the vertical support member (2) while preventing movement in the horizontal plane. A gas spring (2*b*) located inside the tubular vertical support member (2) also connects the carriage structure and the vertical support member (2) (See FIG. 4 and FIG. 6).

Figure 2:
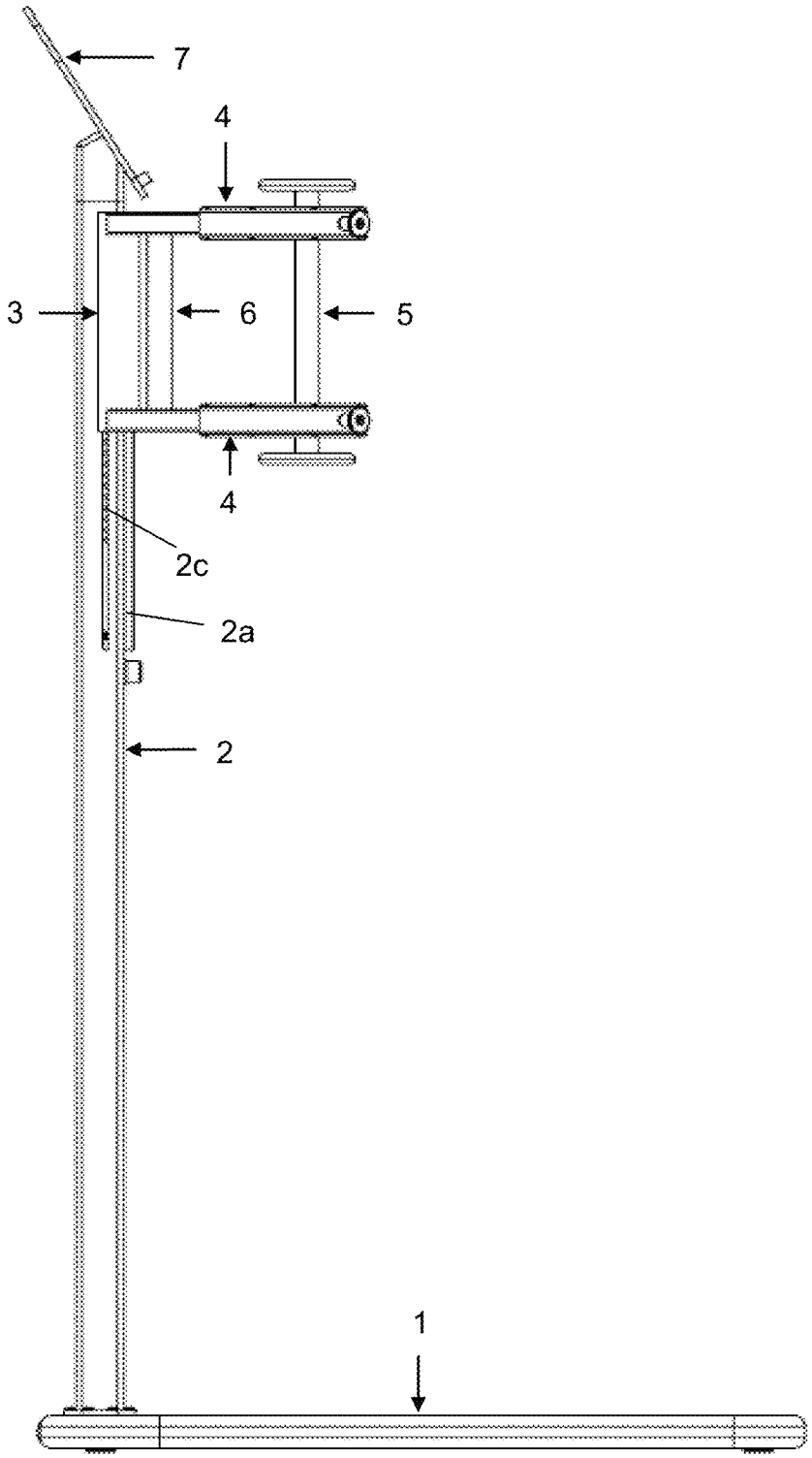
FIG. 2 includes a side view of the balance rehabilitation and training apparatus of FIG. 1.
Figure 3:
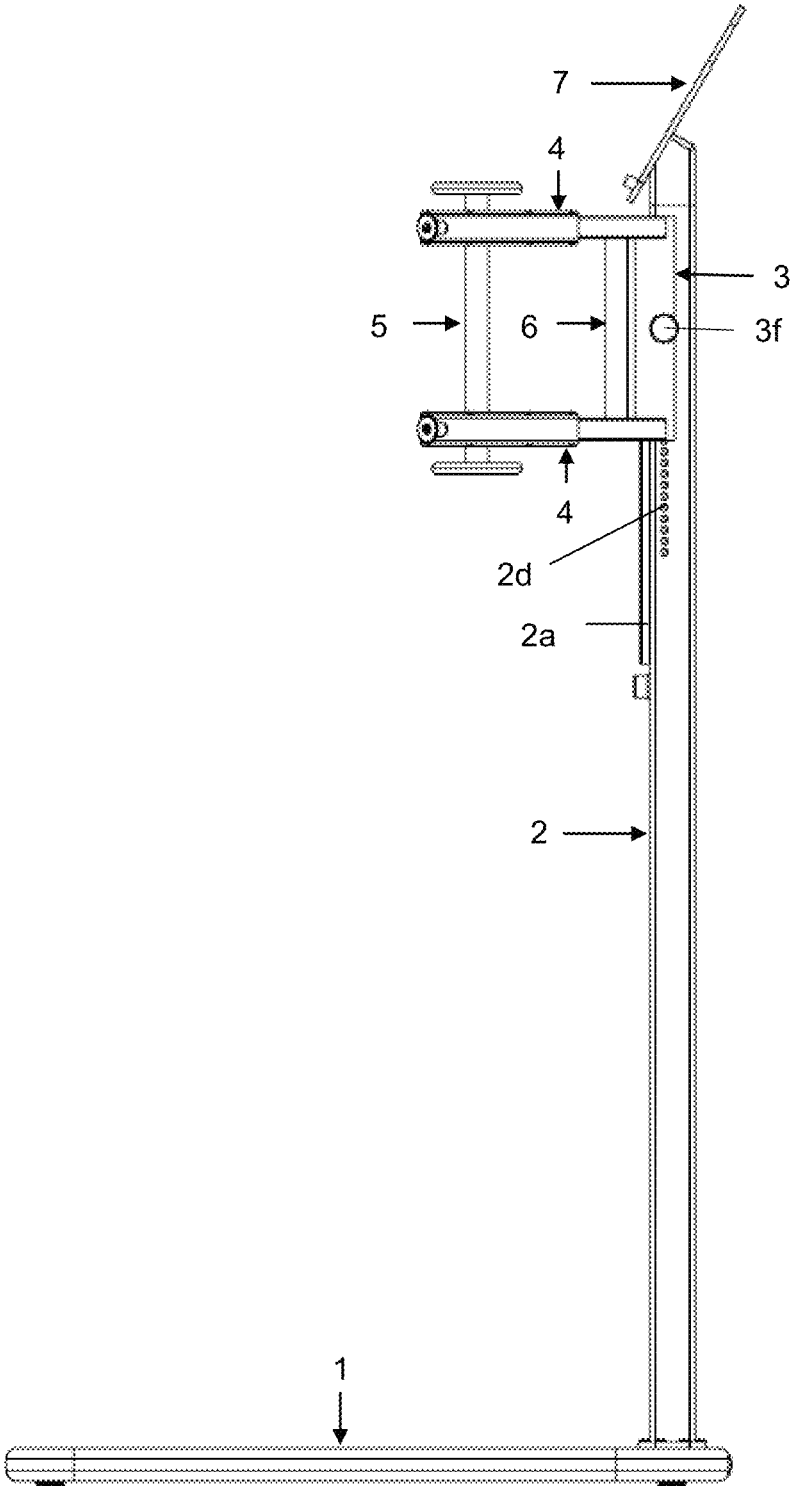
FIG. 3 includes a side view (opposite FIG. 2) of the balance rehabilitation and training apparatus of FIG. 1.
Figure 4:
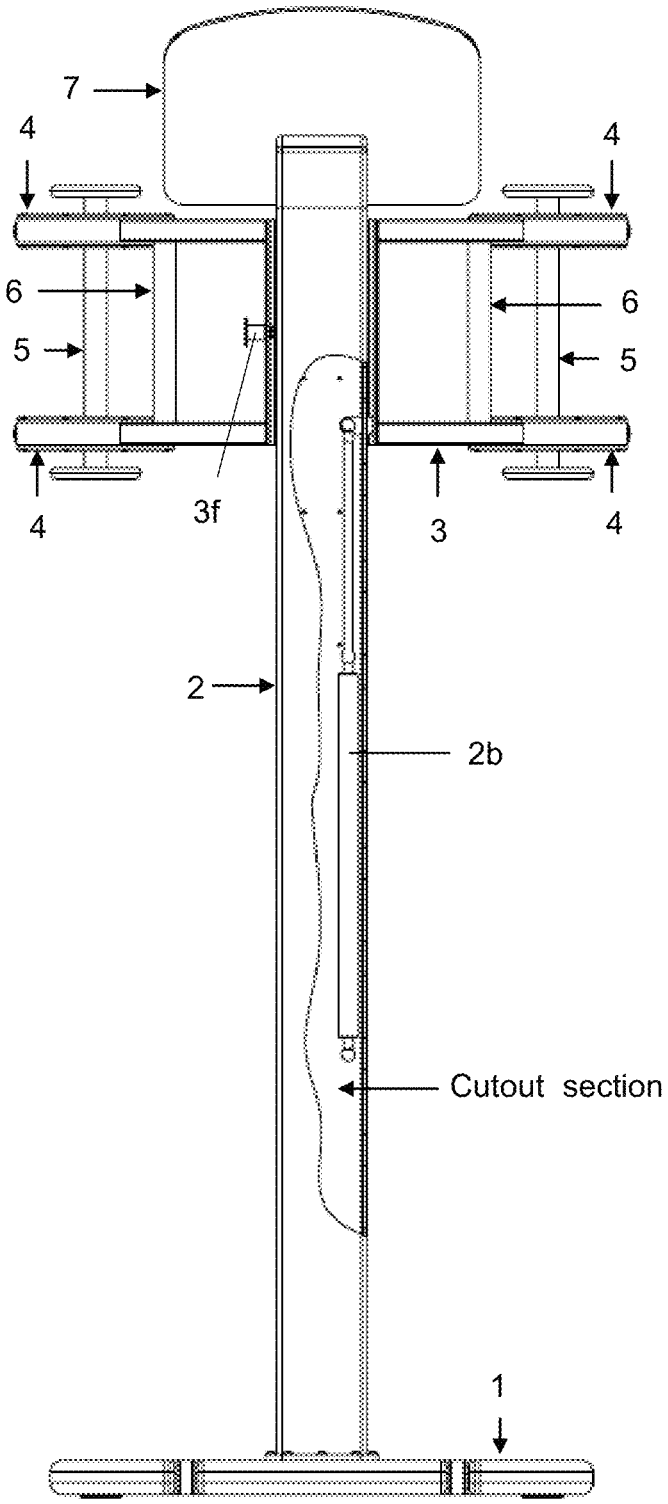
FIG. 4 includes a rear view of the balance rehabilitation and training apparatus of FIG. 1. The view also includes a cutout section of the tubular vertical support member to show the gas spring located within.

Referring generally to FIG. 4, then more specifically to FIG. 6 the gas spring (2*b*) assists with the movement of the carriage up and prevents the carriage from rapidly falling downward. One end of the gas spring (2*b*) is connected to the center carriage member (3*a*). The other end of the gas spring (2*b*) extends downward toward the base member (1) inside of the hollow vertical support member (2) and is connected to the vertical support member (2) by fastening means (See FIG. 4). Referring to FIG. 2, an opening or slot (2*c*) on the side of the vertical support member (2) allows the connection between the carriage structure (3) which is on the outside and the gas spring (2*b*), which is inside the vertical support member (2). The stability of the carriage is controlled by a carriage spring-loaded pin (3*f*) (See FIG. 1 and FIG. 7) such that when engaged the pin extends from the carriage structure (3), specifically the center carriage member (3*a*), through a hole in the vertical support member (2) thus locking it in place. The vertical support member (2) has a series of holes (2*d*) (See FIG. 3), which allow the carriage spring-loaded pin (3*f*) on the carriage to engage with the vertical support member (2) at numerous locations along the range of motion. When the carriage spring-loaded pin (3*f*) is pulled and held out, it disengages from the hole (2*d*) on the vertical support member (2) and allows the carriage to move up and down within the range of motion of the linear slide rail system.

Figure 9:
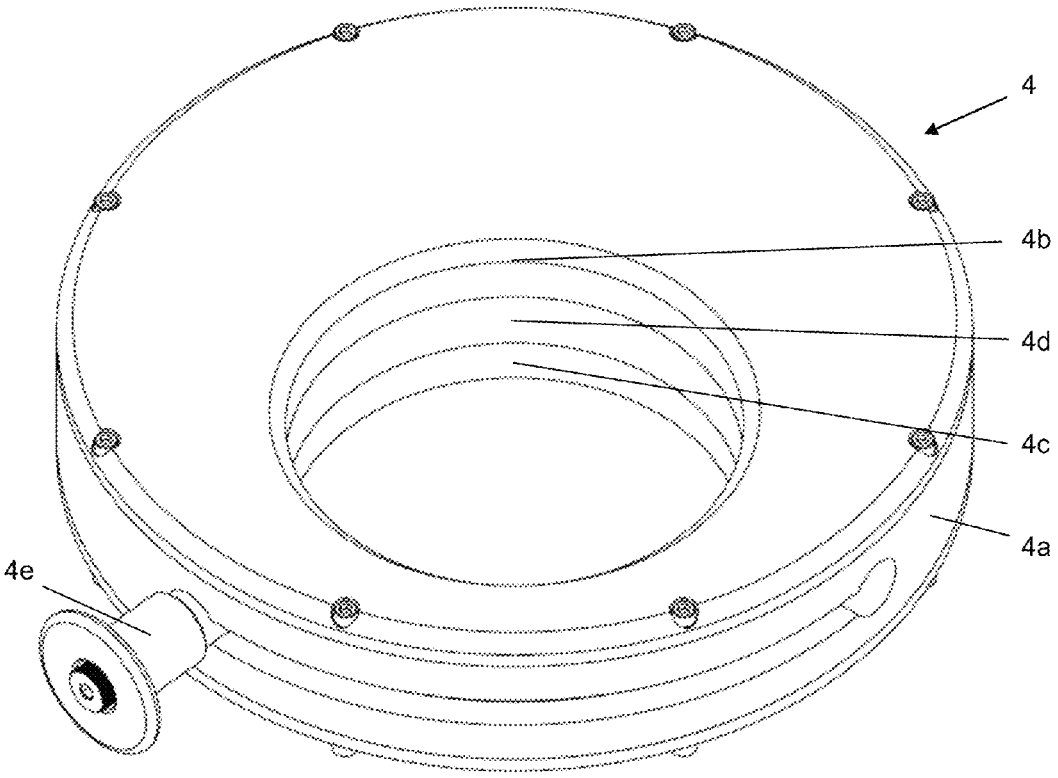
FIG. 9 includes an expanded view of the open sway area for a free-floating handle container of the balance rehabilitation and training apparatus of FIG. 8.
Figure 10:
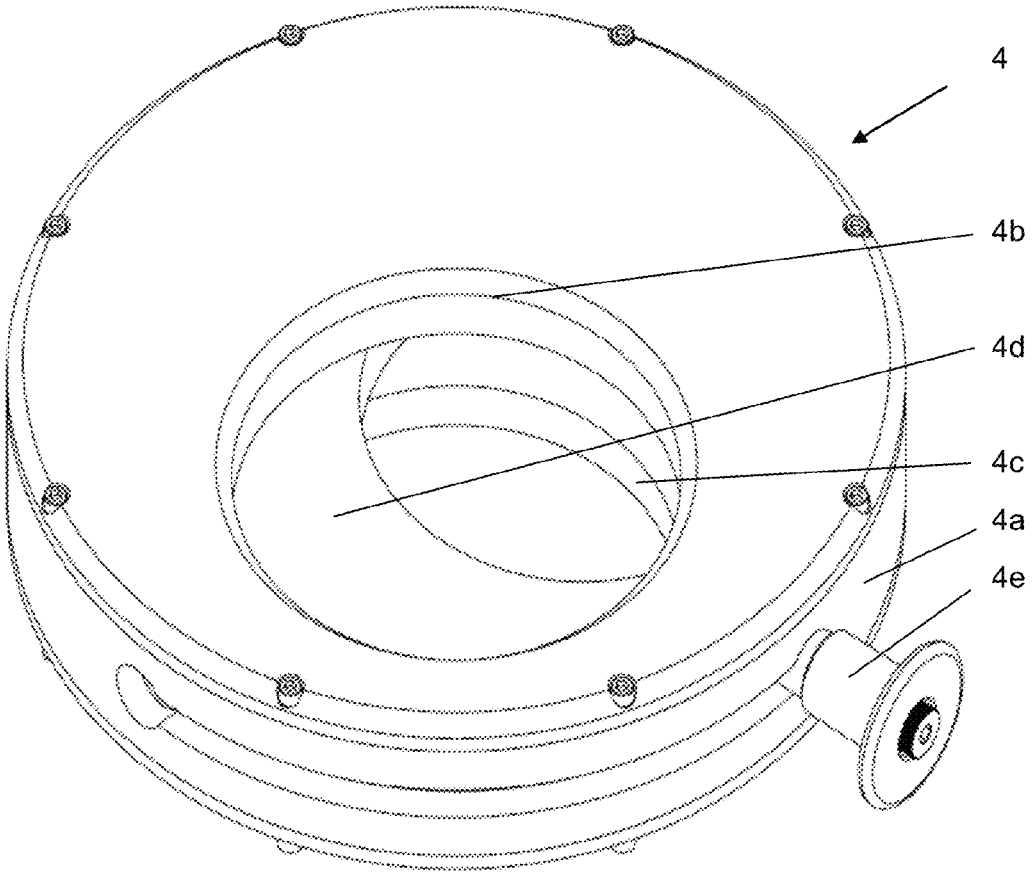
FIG. 10 includes an expanded view of the alternate position for a free-floating handle container of the balance rehabilitation and training apparatus of FIG. 8.

A free-floating handle container member (4) which provides an adjustable postural sway area is envisioned in this invention. In this embodiment, referring now to FIG. 8, the free-floating handle container member (4) comprising an annular member (4*a*), a sway area spring-loaded pin (4*e*) and three additional conic disks (4*b*, 4*c*, 4*d*) with each disk circumscribing a free sway orifice. Two of the disks are container disks (4*b*, 4*c*) which are identical and thus have the same diameter and an eccentric (not centered) orifice (See (FIG. 5). Referring back to FIG. 8, These two disks are positioned such that one is located on the top (4*b*) and one on the bottom (4*c*) of the annular conic member (4*a*). A portion of these disks (4*b*, 4*c*) are recessed to fit within the annular member (4*a*). The top and bottom disks (4*b*, 4*c*) are oriented so the orifices are aligned and are secured with a plurality of fasteners to the annular member (4*a*). A portion of the top and bottom disks (4*b*, 4*c*) is recessed within the annular member (4*a*) creating a space between them. The third conic disc is a sway area adjustment disk (4*d*) and it has an eccentric (not centered) orifice. The sway area adjustment disc (4*d*) is contained between the top and bottom disc (4*b*, 4*c*) as well as within the annular member (4*a*). When the top and bottom disks are secured the sway area adjustment disk (4*d*) is not removable. Although, the sway area adjustment disk (4*d*) is contained between the top and bottom disk (4*b*, 4*c*), it is rotatable within and concentric with the annular member (4*a*). The eccentric orifice in the sway area adjustment disk (4*d*) is appropriately offset and sized such that when in the open position, it presents no obstruction in the orifices in the top and bottom disks (4*b*, 4*c*), thus creating a first open sway area as illustrated in FIG. 9. Conversely, when the sway adjustment disk (4*d*) is rotated to an alternate position, part of the eccentric orifices in the top and bottom disks (4*b*, 4*c*) is obstructed by the sway area adjustment disk (4*d*) and a second sway area is created as illustrated in FIG. 10. Thus, the handle container assembly in this embodiment comprises different settings to create adjustable sway areas.

Referring back to FIG. 8, FIG. 9 and FIG. 10, there is a sway area spring-loaded pin (4*e*) in the free-floating handle container member (4) that is adjustably connected to the sway area adjustment disk (4*d*). When the sway area spring-loaded pin is pulled out, it disengages from the annular member (4*a*) and allows the sway area adjustment disk (4*d*) to rotate in the horizontal plane between the top and bottom disks (4*b*, 4*c*). The annular member (4*a*) has a hole in which the sway area spring-loaded pin (4*e*) recesses at each position and an opening/slot to allow for the movement of the sway area spring-loaded pin (4*e*) between the positions.

Referring now to FIG. 7, the free-floating handle (5) is comprised in this embodiment of a rod (5*a*) with a top disk (5*b*) and a bottom disk (5*b*) adjustably attached on each end. The diameter of the rod (5*a*) is such that it can be gripped comfortable by children and adults. The free-floating handle (5) may include an optional cushioned grip that can vary in size depending on the size of the user's hand. The diameter of the disks (5*b*) is greater than the diameter of the orifices in the free-floating handle container member (4). The height of the free-floating handle (5) exceeds the height of the carriage (4). The rod (5*a*) is placed in the free-floating handle container member (4) and then the top and bottom disk (5*b*) are adjustably attached which contains the free-floating handle (5) within the opening of the free-floating handle container member (4). When the vertical handles (5) are not in use by the user they are supported by the top disk (5*b*) (e.g., a first vertical stop) on the free-floating handle container member (4). The bottom disk (5*b*) prevents the handle from being lifted out of the free-floating handle container member (4) (e.g., a second vertical stop). Therefore, the handle is free-loating within the opening, free sway orifice, in the free-floating handle container member (4) but vertically constrained within the area due to the disks (5*b*) on the top and bottom of the rod (5*a*) acting, for example, as respective first and second vertical stops. The user can hold the free-floating handles (5) within the free sway orifice so the handle is not touching any part of the free-floating handle container member (4) and carriage structure (3). When the user holds the handle in the center of the free-floating handle container member (4) the top and bottom disks extend above and below the horizontal plane of the carriage (3). The handles are moveable vertically and horizontally within the area inscribed by the free sway orifice in the free-floating handle container member (4).

The free-floating handle (5) is movable without resistance within the free sway orifice in the free-floating handle container member (4) to allow postural sway during exercise. However, the otherwise free-floating handle (5) becomes restrained when moved to the outside of the opening and thus limits sway and prevent the user from falling. As described, the postural sway during balance training is necessary for the reinforcement of the appropriate motor program needed to improve balance. Holding onto a stable object does not permit postural sway and thus hinders the effectiveness of the balance training exercise. If the user's postural sway becomes too large, the handles limit the sway to within the area inscribed by the opening. If the user loses balance and begins to fall, the handles will be pushed against the free-floating handle container member (4) thus supplying support and preventing the user from falling. In addition, the disk (5*b*) on the top and bottom of the rod (5*a*) allow the handles to be movable without resistance in a limited vertical motion.

The stable handles (6) in FIGS. 1-4 and FIG. 7, are comprised of a rod, tube, or bar for users who may require completely stable support while performing some or all of the exercises. The two stable handles (6) are rigidly fixed between the top and bottom arched horizontal tubular carriage arms (3*b*, 3*c*, 3*d*, 3*e*) on both sides of the carriage (3) (See FIG. 7). They are positioned near the center of the longitudinal arched tubular carriage arms so they don't interfere with the free-floating handles. The stable handles (6) can be adjusted such that they are at the correct user height by adjusting the carriage structure (3) as described above.

Figure 11:
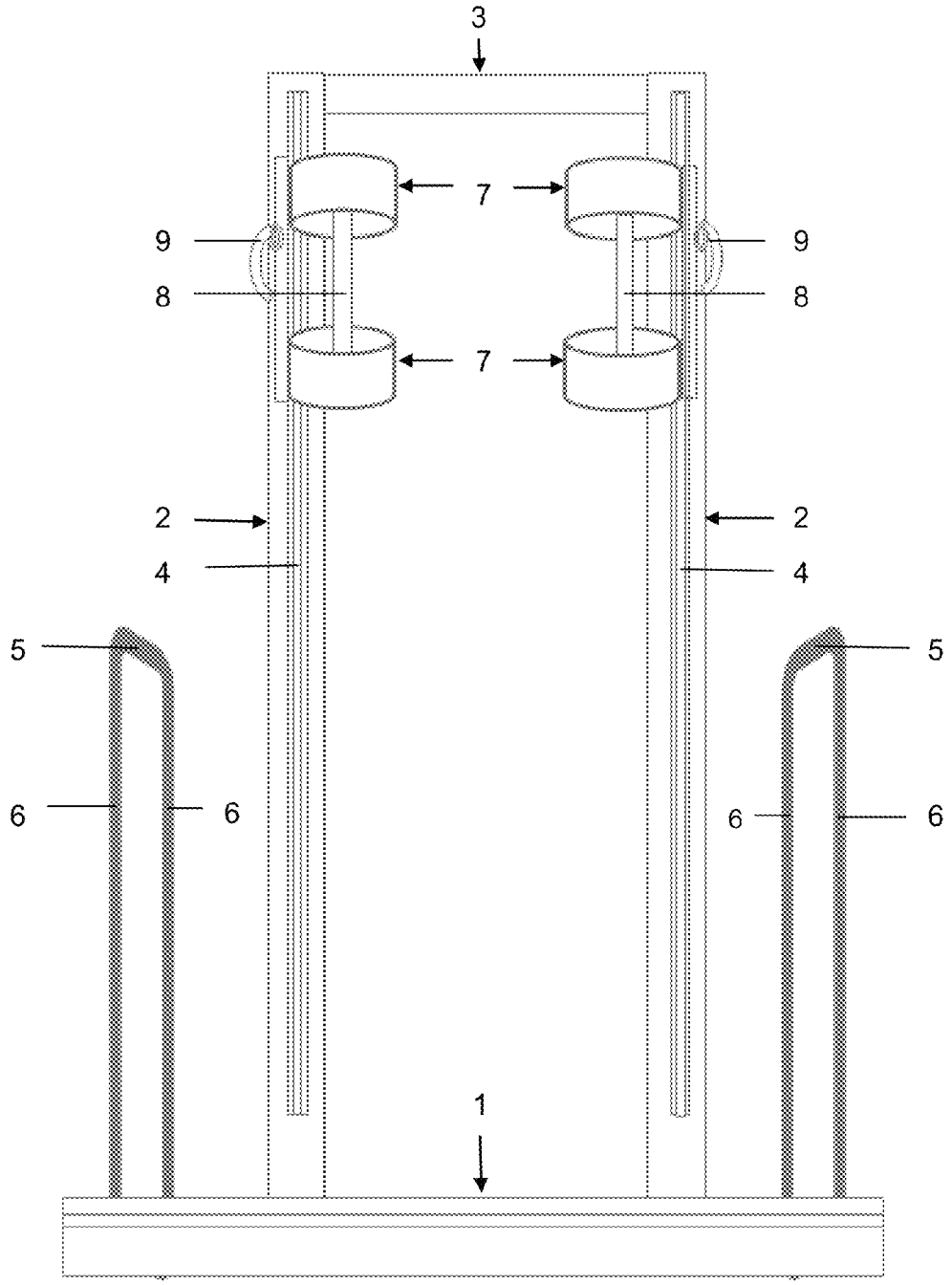
FIG. 11 includes a front facing view from the perspective of the user of an embodiment of the balance rehabilitation and training apparatus utilized in study 1 and study 2

Referring to FIG. 11, an optional feature includes vertical handrail support members (6) supporting horizontal handrails (5). In this embodiment, on both sides of the platform where the user stands, horizontal handrails (5) are connected to either a singular or plurality of vertical handrail support members (6) connected to the base member. The vertical handrail support members (6) are either stationary or telescoping, which supports enable easy height adjustments of the horizontal handrails (5). The vertical handrail support members (6) are separate from the vertical support member (2). The horizontal handrails (5) follow the same contour as the base member (1) and provide support for the user while performing balance rehabilitation or training. This may be appropriate to provide stable support for patients with diminished functional balance until balance improves and utility of the free-floating handles (8) is feasible.

Another optional feature, referring now to FIGS. 1-5, is a lectern type structure (7) that extends above the top vertical support member (2). In this embodiment a portion of a support member extends partially downward inside the top of the hollow tubular vertical support member (2). The structure is connected to the support member (2) by a plurality of fastening means. The structure provides a surface area for written instructions, warnings, and sample exercises. It also so serve as an area to hold papers, magazines, keys, phones, etc.

In an embodiment of the invention includes another optional feature which includes a hinged member between the base member (1) and the vertical support member (2). This hinged member would allow the apparatus to be folded for ease in storage and transport.

In an embodiment of the invention includes a space saving assembly. Referencing FIG. 1, the apparatus includes a vertical support member (2), a U-shaped carriage structure (3) to which the free-floating handle container members (4) free-floating handles (5), and optional stable handles (6) are attached as described previously. The apparatus is similar to the portable apparatus except the vertical support member (2) is truncated below the bottom mount of the gas spring (2*c*) (See FIG. 4) and thus not mounted to a base member (1). In one embodiment, the vertical support member (2) is attached directly to a wall or stable structure. In another embodiment, a singular or plurality of members attach to the vertical support member (2) and these members can be attached to a wall or stable structure. The space saving portable apparatus can be attached to a wall or other stable structures such as a table, door, exercise equipment, rehabilitation equipment/apparatus, etc.

In another embodiment of the invention the free-floating handles can utilize various mechanisms which detect positional changes in the free-floating handles and provide feedback information to the user and or the therapist. Various systems can be utilized to achieve this including but not limited to: accelerometers, gyroscope and ohmic sensing devices. Input from these various devices can provide feedback to the user and or therapists through visual, auditory, and tactile stimuli as well as other stimuli.

Figure 12:
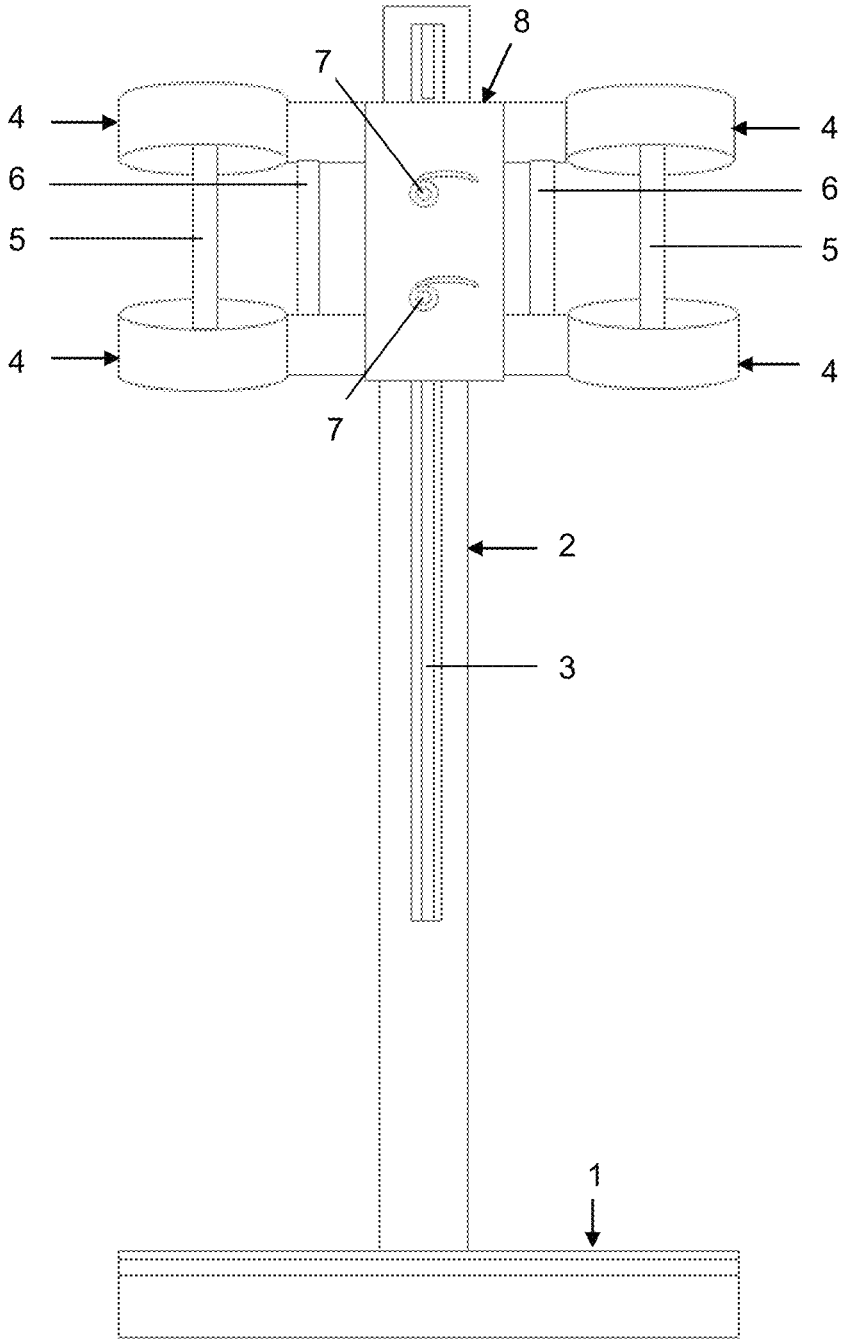
FIG. 12 included a front facing view from the perspective of the user of an embodiment of the balance rehabilitation and training apparatus utilized in study 2

Another embodiment comprises a free-floating handle which is movable within the confines of handle container member wherein a container member has an open end and a closed end (See FIG. 11, FIG. 12). The open end of the member receives and confines the free-floating user handle member and inscribes the free sway area of the handle. The closed end restrains the longitudinal travel of the free-floating user handle (e.g., a vertical stop). A set of two containing members are supported parallel to each other with an adjustable space between them and with the handle interspaced between them such that the free-floating user handles can be positioned free of restraint by either of the container members. It is envisioned therefore that a top container member may have a closed top end (e.g., a vertical stop) in combination with an open bottom end and the bottom container member may have an open top end in combination with a closed bottom end (e.g., a vertical stop). In each case, at least one end of the container member must be open to receive the free-floating handle member. (Illustrated in FIG. 11 and FIG. 12).

In another embodiment, a set of two containing members are supported parallel to each other with an adjustable space between them and with the handle interspaced between them such that the free-floating user handles can be positioned free of restraint by either of the container members. It is envisioned that a combination of the top and bottom container member illustrated in FIGS. 11-12 with those in FIG. 1.

In another embodiment, a set of two containing members are supported parallel to each other with an adjustable space between them and with the handle interspaced between them such that the free-floating user handles can be positioned free of restraint by either of the container members. It is envisioned the two containing members could be positioned vertically or horizontally or at any angle between vertical and horizontal as well as in front or on the side of the user or a combination thereof.

The shape of the orifice created by the container members could include but are not limited to conic and or annular, polyhedral forms, including squares, rectangles, parallelogram, or various regular and or irregular shapes. In each case the container member provides a free sway area inscribed by the form and shape of the orifice. The inscribed area or shape of the sway area may be adjusted to accommodate the specific sway patterns or deficits in sway patterns for the individual or patient.

Figure 8:
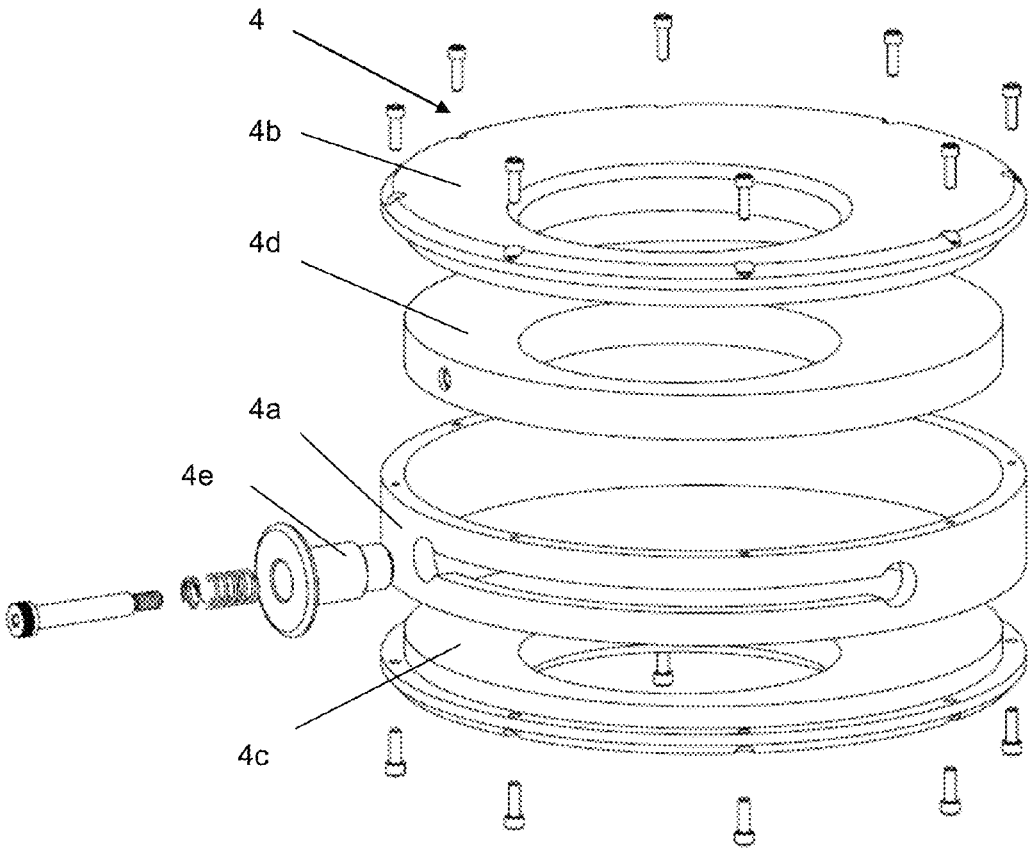
FIG. 8 includes an expanded view of a free-floating handle container of the balance rehabilitation and training apparatus of FIG. 1.

A variable sway area adjustment member is envisioned to include at least one sway area adjustment disk which is positioned within the handle container members (See FIG. 8, FIG.

9, and FIG. 10). The sway area adjustment disk may have different sized, positioned, or shaped inscribed orifices to create different sway areas to accommodate the level of postural challenge and patient characteristics.

In another embodiment, the handle container member of FIG. 11 and FIG. 12 is envisioned with the sway area inscribed with difficulty rings that fit on or within the handle container member. A plurality of difficulty rings are envisioned that have various size and shaped inscribed orifices and the rings are easily changed within the container members to effectively change the area or shape of the sway area.

A variable orifice adjusting mechanism using an iris shutter is also envisioned as a means of adjusting the sway area. A plurality of iris blades can be utilized within the container member. The inscribed area of the orifice can be changed by adjustable rotating the iris blades within the container member.

In another embodiment, the handle container member of FIG. 11 and FIG. 12 is envisioned with the sway area adjustable by changing the handles. Specifically, a plurality of handles could be utilized that have unique size and shaped members that fits within the container member. A plurality of size and shape handle members would change the sway area.

In other embodiments of the invention the base or platform may comprise an oval, a circular form, a square base, a rectangular, triangular form or the like.

In other embodiments of the invention the carriage structure may comprise a structure about shoulder-width and partially surround the form of the user and wherein such carriage structure may comprise a u-shaped, half-circular form, a half-square form, a triangular form or the like.

The disclosed balance training apparatus can be utilized alone or in conjunction with other balance apparatus to compliment postural challenges. Examples of these apparatus include but are not limited to: balance beam, standing on unstable surfaces (foam, padding, pillow, etc) unstable circular board, fulcrums, Bosu® apparatus, BAPS® (Biomechanical Ankle Platform System), Nintendo Wii System®, etc. The apparatus can also be integrated with a force platform and audio, visual, and tactile feedback systems. The platform can be used to provide perturbations in the surface to challenge the individual. The platform and handles can be integrated such that the platform can provide a perturbation and the force exerted on the handles by the patient can be measured. The feedback system can provide cues regarding when the participant has moved the handles outside a defined range of motion. Accelerometers and gyroscope can be used in the free-floating handles to detect movement and rotation in three axes. Ohmic sensing device can also be used to detect movement. This system can track these perturbations and evaluate the changes during exercise as well as over time. These data can be evaluated by a therapist to determine disease progression or the effects of treatments. A video screen could be included with the balance rehabilitation and training apparatus to provide audio and visual feedback during balance training. Audio and visual signals on the video screen as well as lights, buzzer or chimes could be used to notify the user when the handles are moved outside a defined range of motion. Other feedback mechanisms could include proprioception/tactile feedback through pulsing or vibrating handles.

In another embodiment which was used for study 1 and study 2, the balance apparatus comprises a base (1), a vertical support (2), a free-floating container member (7), a free-floating handle (8), a stable handrail (5) (See FIG. 11). A vertical support member (2) comprises two support structures positioned parallel to one another and spaced apart. The two vertical support structures (2) are connected at the top by a horizontal cross member (3). A handle container member (7) is adjustably attached to a vertical support member (2) with a linear slide rail system (4). In addition this embodiment incorporates horizontal handrails (5) that partially encompass the base (1). This embodiment comprises in addition two independent vertical free-floating handles (8) that are contained in the handle container member (7). The height of the container member (7) is adjusted by a handle (9) connected to the slide rail system (4).

In another embodiment which was used for study 2, the balance apparatus comprises a base (1), a vertical support (2), a carriage structure (8) which includes; a free-floating container member (4), a free-floating handle (5), and a stable handle (6). A vertical support member (2) and is connected to the base (1) and also supports the carriage structure (8). A handle container member (4) is attached to a carriage structure (8) with a linear slide rail system (3). The height of the carriage structure (8) is adjusted by a plurality of handles (7) which connected the carriage structure (8) to the vertical support (2) with the slide rail system (3).

Study 1

This study evaluated normal individuals using the balance rehabilitation and training apparatus as described in the embodiment of FIG. 11. The results demonstrate that with the free-floating handles, normal subjects have postural sway characteristics similar to free standing (i.e., not holding onto anything) but different than handrail holding (i.e., holding onto a stable object). Handrail holding during balance exercise would minimize postural sway and limit reinforcement of the appropriate motor program.

This study was performed on six adult subjects, with no history of neurological or musculoskeletal deficits. The mean age for the subjects was 35.5 yrs. To measure the postural sway, the center of pressure data (COP) was collected by a portable force platform (Kistler, Model 9286AA, Kistler Instruments, Winterhur, Switzerland). Standing sway was measured on the balance rehabilitation and training apparatus in six different conditions: free standing-eyes open (FS-EO), free standing-eyes closed (FS-EC), handrail holding-eyes open (HH-EO), handrail holding-eyes closed (HH-EC), and free-floating handles holding (FFH)-eyes open (FSH-EO) and free-floating handles holding-eyes closed (FFH-EC). In all conditions, subjects were tested barefooted and all conditions were randomly administered to each subject to eliminate any order effect for testing.

In the FS-EO and FS-EC condition subjects were instructed to stand quietly on the force platform and to not intentionally alter their standing posture or in any way interfere with their postural sway. During the HH-EO and HH-EC conditions, testing procedures were identical to the FS-EO and FS-EC condition with the exception that subjects grasped a handrail with the left and right hand. This handrail was at waist height. In the FSH-EO and FSH-EC condition, testing procedures were again identical to the FS-EO and FS-EC condition with the exception that subjects grasped the free-floating handles which were located directly in front of the subject at approximately waist level. There was a minimum five minute rest interval between each testing condition. Each trial lasted for 60 seconds during which the center of pressure was recorded every 0.002 seconds.

All analyses were performed in the Matlab environment using custom-written computer codes. The force platform data were down-sampled to 100 Hz and filtered using an eighth order Butterworth low-pass filter with a cutoff frequency of 20 Hz. The trajectory of the center of pressure (COP) was calculated from the force platform data according to the recommendations of the manufacturer. To assess the amount of postural sway, path length (in mm) was measured, which is the total length that the subject's COP moved during the 60 second trial. Sway area (mm2) was the area defined by the outermost movements of the center of pressure in the medial-lateral (side to side) and the anterior-posterior (front to back) directions for the entirety of the one-minute trial. A comprehensive explanation of these variables is detailed in the original work of Hufschmidt and colleagues (Hufschmidt et al., 1980, Arch Psychiatr Nervekn).

To further quantify the changes in postural sway between conditions, the detrended fluctuation analysis method (DFA) was used for the COP trajectory in both the anterior-posterior (AP) and the medial-lateral (ML) components of sway. This method has been extensively used for the investigation of many biological phenomena, including postural sway (Duarte and V. Zatsiorsky, 2000, Neurosci. Lett, 283: 173-176 and Zatsiorsky and Duarte 2000, Motor Control, 4(2): 185-200), and has been recently described (Tahayori, et al., 2012, Motor Control, 16(2): 144-157). Briefly, this procedure examines the dynamic complexity of the postural sway signal (termed alpha), with higher alpha values representing more complex postural sway. A repeated measures one-way analysis of variance (ANOVA) was performed for all variables with three conditions: FS, HH, and FSH. Data were analyzed separately for the eyes open and eyes closed conditions. Bonferroni post-hoc analyses were completed when significant ANOVA results were found to examine where differences existed between conditions.

Results

Postural Sway Area

ANOVA Results:

Eyes open: Significant F-ratio, $F(2,10)=5.392$, $p=0.026$

Eyes closed: Significant F-ratio, $F(2,10)=7.373$, $p=0.011$

Bonferroni post-hoc results: eyes open and eyes closed

FS is different than HH ($p<0.05$)

FSH is different than HH, ($p<0.05$)

No difference between FS and FSH, ($p>0.05$)

Postural Sway Path Length

ANOVA Results:

Eyes open: Significant F-ratio, $F(2,10)=10.159$, $p=0.004$

Eyes closed: Significant F-ratio, $F(2,10)=47.72$, $p<0.001$

Bonferroni post-hoc results: eyes open

FS is different than HH ($p<0.05$)

Bonferroni post-hoc results: eyes closed

FS is different than HH ($p<0.05$)

FSH is different than HH, ($p<0.05$)

No difference between FS and FSH ($p>0.05$)

Alpha-Anterior/Posterior Complexity

ANOVA Results:

Eyes open: Significant F-ratio, $F(2,10)=28.723$, $p<0.001$

Eyes closed: Significant F-ratio $F(2,10)=22.443$, $p<0.001$

Bonferroni post-hoc results: eyes open and eyes closed

FS is different than HH ($p<0.05$)

FSH is different than HH, ($p<0.05$)

No difference between FS and FSH ($p<0.05$)

Alpha-Medial/Lateral Complexity

ANOVA Results:

Eyes open: Significant F-ratio, $F(2,10)=3.54$, $p=0.07$

Eyes closed: Significant F-ratio $F(2,10)=0.178$, $p=0.840$

Results Summary No difference in postural sway path, area and complexity when using the free-floating handles compared to free standing in the eyes opened and eyes closed conditions.

Postural sway variables during the handrail holding-eyes opened and eyes closed conditions are significantly different than the other two conditions: free-floating handles and free standing.

Conclusion

The free-floating handles on the balance rehabilitation and training apparatus allow the users to experience postural sway similar to free standing while not affecting the complexity of the postural sway signal. Also, the free-floating handles allow significantly more postural sway compared to stable handrail holding.

Study 2

A case study was performed to evaluate the effects of a balance exercise training program using the balance rehabilitation and training apparatus as described in the embodiments of FIG. 11 and FIG. 12. The results demonstrate positive improvements in postural control as a result of using the balance rehabilitation and training apparatus during a 4-week training program.

The subject was a generally healthy individual (age—63 yrs) with no significant medical issues or history of neurological or musculoskeletal deficits. To measure the postural sway, the center of pressure data (COP) was collected with a portable force platform (Kistler, Model 9286AA, Kistler Instruments, Winterhur, Switzerland). Static standing sway was measured by having the subject stand barefooted on the force platform in two different conditions: free standing-eyes open and free standing-eyes closed. For both conditions, the subject was instructed to stand as still as possible on the force platform for 90 seconds during which the center of pressure was recorded every 0.002 seconds. Static balance was assessed at baseline and then after training with the same testing procedures.

All analyses were performed in the Matlab environment using custom-written computer codes. The force platform data were down-sampled to 100 Hz and filtered using an eighth order Butterworth low-pass filter with a cutoff frequency of 20 Hz. The trajectory of the center of pressure (COP) was calculated from the force platform data according to the recommendations of the manufacturer. To assess the amount of postural sway, path length (in mm) was measured, which is the total length that the subject's COP moved during 60 seconds of the 90 second trial. Sway area (mm2) was the area defined by the outermost movements of the center of pressure in the medial-lateral (side to side) and the anterior-posterior (front to back) directions for the entirety of the one-minute trial. A comprehensive explanation of these variables is detailed in the original work of Hufschmidt and colleagues (Hufschmidt et al., Arch Psychiatr Nervekn, 1980, 228: 135-150).

To further quantify the changes in postural sway between baseline and post-training, the detrended fluctuation analysis method (DFA) was used for the COP trajectory in both the anterior-posterior (AP) and the medial-lateral (ML) components of sway. This method has been extensively used for the investigation of many biological phenomena, including postural sway (Duarte and V. Zatsiorsky, 2000, Neurosci. Lett, 283: 173-176 and Zatsiorsky and Duarte 2000, Motor Control, 4(2): 185-200), and has been recently described (Tahayori, et al., 2012, Motor Control, 16(2): 144-157). Briefly, this procedure examines the dynamic complexity of the postural sway signal (termed alpha), with higher alpha values representing more complex postural sway. Descriptive data were reported for the subject Pre-Training and Post-Training.

Balance Training

The subjects reported to the laboratory 3 days per week for 4 weeks to perform balance exercise training. Balance exercises were performed on both the balance rehabilitation apparatus described in the embodiment as described and illustrated in FIG. 11 and FIG. 12. A customized balance exercise program was prescribed by a licensed physical therapist. The difficulty of the balance exercises was established based on the functional balance ability of the subject. The same exercises in the same order were performed each week and the exercises were changed to increase the difficulty at the beginning of every week. Individual exercises were approximately 30-60 seconds in durations with each exercise session lasting approximately 15 minutes. An exercise session included approximately 20 exercises and included these types of exercises: static standing, weight shifts (toe-heel, right-left), head turns (up-down, right-left), stationary marching (with and without foam). Exercises were performed with eyes open and eyes closed.

Results

There were no differences in sway characteristics between Pre-Training and Post-Training for the eyes open condition. This can be explained by visual system's powerful influence on static balance which therefore over-rode the other mechanisms of improvements in the control of balance.

Sway Area-Center of Pressure (Mm2)

Eyes closed: Pre-Training=5.57 mm2, Post-Training=3.97 mm2,

Percent change=28.63%

Sway Area-Standard Deviation of the x-Axis

Eyes closed: Pre-Training=0.79 mm, Post-Training=0.77 mm,

Percent change=2.3%

Sway Area-Standard Deviation of the y-Axis

Eyes closed: Pre-Training=0.58 mm, Post-Training=0.42 mm,

Percent change=27.6%

Rambling and Trembling Analysis

Rambling Component

Eyes closed: Pre-Training=0.58 mm, Post-Training=0.48 mm,

Percent change=17.1%

Trembling Component

Eyes closed: Pre-Training=0.11 mm, Post-Training=0.25 mm,

Percent change=214.0%

Results Summary

No change Pre-Training and Post-Training for all variables in the eyes opened condition.

Improvements in postural sway characteristics Post-Training compared to Pre-Training for all variables in the eyes closed condition.

Conclusion

There were substantial improvements in sway characteristics between Pre-Training and Post-Training for the eyes closed condition.

Two components of postural sway called rambling and trembling were evaluated before and after training. During normal standing, the amount of sway is coordinated by both the descending control from the cortex, as well as the segmental or lower level control (spinal cord control) from the proprioceptors of the foot and leg musculature. The rambling component of the de-trended analysis refers to the cortical control of the sway pattern whereas the trembling component refers to the proprioceptive control of the sway parameters. There were no changes Pre-Training and Post-Training for the eyes open condition. Conversely, in the eyes closed condition the rambling component decreased by 17.13% (from 0.58 mm to 0.48 mm) and the trembling component increased 214% (from 0.11 mm to 0.25 mm) after training. This is very interesting because when rambling and trembling change in opposite directions it is associated with positive changes in balance characteristics. These changes equate to the control of the postural sway signal being transferred from a more cortical dominant control (rambling) to a more proprioceptive dominant control (trembling). The role of training is to shift this control to the faster and more dynamic proprioceptive mechanisms, which because of their locus in the spinal cord, respond much quicker to sudden disturbances in the postural system; for example, during fall avoidance episodes. This was a positive shift in the control of the center of pressure from the brain toward the reflex and proprioceptive systems. In conclusion, using the balance and rehabilitation and training apparatus during the 4-week training program lead to improved balance characteristics for this subject, and appeared to provide favorable results in shifting the control processes to the faster acting proprioceptive system.

What is claimed is:

1. A balance training apparatus comprising:

a support;

a handle container supported by the support, the handle container including an orifice disposed therethrough; and a handle disposed within the orifice and inscribed by the handle container;

wherein the handle container is constructed such that the handle is movable in both vertical directions within a sway area defined by the orifice between a first vertical stop and a second vertical stop and horizontally within the sway area to an inner perimeter of the handle container such that the handle is movable between at least a first position wherein the handle is not in engagement with the handle container and at least a second position wherein the handle engages the handle container.

2. The balanced training apparatus of claim 1, further comprising a second handle container supported by the support and a second handle, wherein the second handle container includes an orifice disposed therethrough, the second handle container is disposed within the orifice and inscribed by the second handle container such that the second handle is movable in both vertical directions within a second sway area defined by the orifice of the second handle container between a first vertical stop and a second vertical stop, and is movable horizontally within the second sway area to an inner perimeter of the second handle container.

3. The balance training apparatus of claim 2, wherein the support is vertical.

4. The balance training apparatus of claim 3, further comprising a base platform connected to the support.

5. The balance training apparatus of claim 4, wherein the base platform is pivotally connected to the support.

6. The balance training apparatus of claim 5, further comprising a carriage structure extending from the support, wherein the handle container is connected to a distal end of the carriage support.

7. The balance training apparatus of claim 6, wherein the carriage structure extends outwardly from the support forming an approximate U-shaped structure such that a space is disposed between opposite ends of the carriage structure and sized to permit a user to stand within the space.

8. The balance training apparatus of claim 7, wherein the carriage structure is adjustable to multiple positions along the support.

9. The balance training apparatus of claim 8, further comprising a gas spring connected between the support and the carriage structure.

10. The balance training apparatus of claim 6, wherein the carriage structure comprises:

a first arm extending horizontally from one side of the support;

a second arm extending horizontally from the same side of the support as and parallel to the first arm;

a third arm extending horizontally from one side of the support; and a fourth arm extending horizontally from the same side of the support as and parallel to the third arm.

11. The balance training apparatus of claim 10, wherein the handle container comprises:

a first handle container connected to a distal end of the first arm;

a second handle container connected to a distal end of the second arm;

a third handle container connected to a distal end of the third arm; and a fourth handle container connected to a distal end of the fourth arm;

wherein the orifices of the first and second handle containers are vertically aligned and the orifices of the third and fourth handle containers are vertically aligned.

12. The balance training apparatus of claim 11, wherein:

the first handle container includes a first closed end;

the second handle container includes a second closed end;

the third handle container includes a third closed end; and the fourth handle container includes a fourth closed end;

wherein the first and second closed ends are respective vertical stops and the third and fourth closed ends are respective vertical stops.

13. A balance training apparatus comprising:

a support member;

a handle container member supported by the support member, wherein the handle container member comprises:

an annular member having a first end and a second end, a first disk disposed partially within and attached to the first end of the annular member, the first disk having an eccentric orifice disposed therethrough, and an adjustable disk positioned within the annular member adjacent to the first disk, the adjustable disk having an eccentric orifice disposed therethrough and movable between at least a first position wherein the orifice of the adjustable disk is aligned with the orifice of the first disk to form a first sway area defined by the aligned orifices and a second position wherein the orifice of the adjustable disk is misaligned with the orifice of the first disk to form a second sway area defined by the misaligned orifices.

14. The balance training apparatus of claim 13, further comprising a handle member disposed within and inscribed by the first disk and the adjustable disk.

15. The balance training apparatus of claim 14, further comprising:

a second disk disposed partially within and attached to the second end of the annular member such that the adjustable disk is disposed between the first and second disks, the second disk having an eccentric orifice disposed therethrough and aligned with the orifice of the first disk;

wherein the handle member is disposed within and inscribed by the first, second, and adjustable disks; and wherein when the adjustable disk is in the first position the orifice of the adjustable disk is aligned with the orifices of both the first and second disks to form the first sway area and when the adjustable disk is in the second position the orifice of the adjustable disk is not aligned with the orifices of the first and second disks to form the second sway area.

16. The balance training apparatus of claim 1, wherein the orifice has a shape selected from the group consisting of conic, annular, polyhedral, and irregular.

17. The balance training apparatus of claim 1, further comprising a lectern-type structure connected to an end of the support.

18. The balance training apparatus of claim 1, wherein the handle includes a sensor to provide feedback regarding a user of the balance training apparatus.

19. A method of balance training comprising: standing adjacent to the support of the balance training apparatus of claim 1;

gripping the handle;

moving the handle to the first position; and performing postural challenges of different magnitudes and temporal orientation while attempting to hold the handle in the first position.

20. A balance training apparatus comprising:

a support;

a handle container supported by the support, the handle container including an orifice disposed therethrough; and a handle disposed within the orifice and inscribed by the handle container;

wherein the handle container is constructed such that the handle is movable between at least a first position wherein the handle is not in engagement with the handle container and at least a second position wherein the handle engages the handle container and in both vertical directions within a sway area defined by the orifice between a first vertical stop and a second vertical stop;

wherein the first vertical stop is a first disk attached to one end of the handle and the second vertical stop is a second disk attached to an end of the handle opposite the first disk, and wherein the first and second disks have diameters that are larger than the orifice.

21. A balance training apparatus comprising:

a support;

a handle container supported by the support, the handle container including an orifice disposed therethrough; and a handle disposed within the orifice and inscribed by the handle container;

wherein the handle container is constructed such that the handle is movable between at least a first position wherein the handle is not in engagement with the handle container and at least a second position wherein the handle engages the handle container, in both vertical directions within a sway area defined by the orifice between a first vertical stop and a second vertical stop, and horizontally within the sway area to an inner perimeter of the handle container;

wherein the handle container is constructed such that the size of the orifice is adjustable, causing the sway area to be adjustable between at least a first sway area and a second sway area, wherein the second sway area is smaller in area than the first sway area.

22. A balance training apparatus comprising:

a support;

a handle container supported by the support, wherein the handle container comprises:

an annular member having a first end, a second end, and an orifice therethrough, a first disk disposed partially within and attached to the first end of the annular member, the first disk having an eccentric orifice disposed therethrough, and an adjustable disk positioned within the annular member adjacent to the first disk, the adjustable disk having an eccentric orifice disposed therethrough and movable between at least a first position wherein the eccentric orifice of the adjustable disk is aligned with the eccentric orifice of the first disk to form a first sway area defined by the aligned eccentric orifices and a second position wherein the eccentric orifice of the adjustable disk is misaligned with the eccentric orifice of the first disk to form a second sway area defined by the misaligned orifices;

a handle disposed within the eccentric orifices of the first disk and adjustable disk and inscribed by the handle container;

wherein the handle container is constructed such that the handle is movable in between at least a first position wherein the handle is not in engagement with the handle container and at least a second position wherein the handle engages the handle container.

23. A balance training apparatus comprising:

a base platform;

a vertical support connected to the base platform;

a hand rail connected to the base platform;

a first handle container supported by the vertical support, the first handle container including a first orifice disposed therethrough;

a first handle disposed within the first orifice and inscribed by the first handle container, wherein the first handle container is constructed such that the first handle is movable between at least a first position wherein the first handle is not in engagement with the first handle container and at least a second position wherein the first handle engages the first handle container, in both vertical directions within a first sway area defined by the first orifice between a first vertical stop and a second vertical stop, and horizontally within the first sway area to an inner perimeter of the first handle container;

a second handle container supported by the vertical support, the second handle container including a second orifice disposed therethrough; and a second handle disposed within the second orifice and inscribed by the second handle container, wherein the second handle container is constructed such that the second handle is movable in both vertical directions within a second sway area defined by the second orifice of the second handle container between a first vertical stop and a second vertical stop and horizontally within the second sway area to an inner perimeter of the second handle container.

* * * * *